US011735116B2

(12) United States Patent
Kim et al.

(10) Patent No.: US 11,735,116 B2
(45) Date of Patent: Aug. 22, 2023

(54) PIXEL CIRCUIT, METHOD FOR DRIVING THE PIXEL CIRCUIT AND DISPLAY DEVICE INCLUDING THE SAME FOR IMPROVING DATA CHARGING

(71) Applicant: LG Display Co., Ltd., Seoul (KR)

(72) Inventors: In June Kim, Paju-si (KR); Jae Woong Youn, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/890,806

(22) Filed: Aug. 18, 2022

(65) Prior Publication Data

US 2023/0073636 A1 Mar. 9, 2023

(30) Foreign Application Priority Data

Sep. 3, 2021 (KR) ..... 10-2021-0117527
Dec. 14, 2021 (KR) ..... 10-2021-0178245

(51) Int. Cl.

| | |
|---|---|
| ***G09G 3/3258*** | (2016.01) |
| ***G09G 3/3291*** | (2016.01) |
| ***G09G 3/3266*** | (2016.01) |
| ***G09G 3/20*** | (2006.01) |

(52) U.S. Cl.

CPC ..... *G09G 3/3258* (2013.01); *G09G 3/2007* (2013.01); *G09G 3/3266* (2013.01); *G09G 3/3291* (2013.01); *G09G 2300/0819* (2013.01); *G09G 2300/0842* (2013.01); *G09G 2310/0286* (2013.01); *G09G 2310/0289* (2013.01); *G09G 2310/08* (2013.01); *G09G 2320/0626* (2013.01)

(58) Field of Classification Search

None

See application file for complete search history.

(56) References Cited

U.S. PATENT DOCUMENTS

| | | | | |
|---|---|---|---|---|
| 7,180,493 | B2 | 2/2007 | Shin et al. | |
| 10,741,122 | B2 | 8/2020 | Pyeon | |
| 2005/0140602 | A1 | 6/2005 | Shin et al. | |
| 2007/0040795 | A1* | 2/2007 | Lee | G09G 3/3648 345/100 |
| 2010/0141643 | A1* | 6/2010 | Li | G09G 3/3648 345/214 |

(Continued)

FOREIGN PATENT DOCUMENTS

| | | | |
|---|---|---|---|
| KR | 10-0578791 | B1 | 5/2006 |
| KR | 10-2018-0036837 | A | 4/2018 |
| KR | 10-2021-0019034 | A | 2/2021 |

*Primary Examiner* — Chun-Nan Lin

(74) *Attorney, Agent, or Firm* — Fenwick & West LLP

(57) ABSTRACT

A pixel circuit, a method for driving the pixel circuit and a display device including the same are disclosed. The pixel circuit includes a driving element including a first electrode connected to a first power line to which a pixel driving voltage is applied, a gate electrode connected to a first node, and a second electrode connected to a second node; a first switch element including a first electrode connected to a second power line to which a data voltage is applied, a gate electrode to which a first scan pulse is applied, and a second electrode connected to the first node; a second switch element including a first electrode connected to the second power line, a gate electrode to which a second scan pulse is applied, and a second electrode connected to the first node.

23 Claims, 19 Drawing Sheets

(56) References Cited

U.S. PATENT DOCUMENTS

| | | | | |
|---|---|---|---|---|
| 2010/0182306 | A1* | 7/2010 | Kimura | G11C 19/28 345/213 |
| 2015/0130785 | A1* | 5/2015 | Shin | G09G 5/18 345/82 |
| 2015/0187273 | A1* | 7/2015 | Chang | G09G 3/3233 345/77 |
| 2016/0203764 | A1* | 7/2016 | In | G09G 3/3291 345/215 |
| 2017/0033129 | A1* | 2/2017 | Hayakawa | G02F 1/13454 |
| 2018/0096650 | A1 | 4/2018 | Pyeon | |
| 2019/0005907 | A1* | 1/2019 | Koo | G09G 3/3607 |
| 2019/0237019 | A1* | 8/2019 | Gao | G09G 3/3233 |
| 2022/0148479 | A1* | 5/2022 | Pyun | G09G 5/008 |

* cited by examiner

PIXEL CIRCUIT, METHOD FOR DRIVING THE PIXEL CIRCUIT AND DISPLAY DEVICE INCLUDING THE SAME FOR IMPROVING DATA CHARGING

CROSS-REFERENCE TO RELATED APPLICATION

This application claims priority to and the benefit of Republic of Korea Patent Application No. 10-2021-0117527, filed Sep. 3, 2021, and Republic of Korea Patent Application No. 10-2021-0178245, filed Dec. 14, 2021, each of which is incorporated by reference in its entirety.

FIELD

The present disclosure relates to a pixel circuit and a display device including the same.

DISCUSSION OF RELATED ART

Electroluminescent display devices may be classified into inorganic light emitting display devices and organic light emitting display devices depending on the material of the emission layer. The organic light emitting display device of an active matrix type includes an organic light emitting diode (hereinafter, referred to as "OLED") that emits light by itself (self-emissive), and has an advantage in that the response speed is fast and the luminous efficiency, luminance, and viewing angle are large. In the organic light emitting display device, the OLED is formed in each pixel. The organic light emitting display device has a fast response speed, excellent luminous efficiency, luminance, and viewing angle, and has excellent contrast ratio and color reproducibility since it can express black gray scales in complete black color.

A pixel circuit of the electroluminescent display device includes the OLED used as a light emitting element, and a driving element for driving the OLED.

A driving frequency applied to the electroluminescent display device is gradually increasing. For example, when the driving frequency increases from 120 Hz to 240 Hz, one horizontal period (1H) is shortened. When one horizontal period is shortened, a data charging rate in the pixel circuit may be reduced, which may result in a decrease in luminance. Therefore, schemes for improving the data charging capability even if the driving frequency applied to the electroluminescent display device increases are required.

SUMMARY

The present disclosure is directed to solving all the above-described necessity and problems.

The present disclosure provides a pixel circuit capable of improving the data charging capability and a display device including the same.

It should be noted that objects of the present disclosure are not limited to the above-described objects, and other objects of the present disclosure will be apparent to those skilled in the art from the following descriptions.

A pixel circuit according to an embodiment of the present disclosure may include a driving element including a first electrode connected to a first power line to which a pixel driving voltage is applied, a gate electrode connected to a first node, and a second electrode connected to a second node; a first switch element including a first electrode connected to a second power line to which a data voltage is applied, a gate electrode to which a first scan pulse is applied, and a second electrode connected to the first node; a second switch element including a first electrode connected to the second power line, a gate electrode to which a second scan pulse is applied, and a second electrode connected to the first node; a light emitting element including an anode electrode connected to the second node, and a cathode electrode connected to a third power line to which a low potential power voltage is applied; and a capacitor connected between the first node and the second node.

According to the present disclosure, two switch elements that are turned on according to a gate-on voltage of a scan pulse are connected in parallel between a data voltage line and a gate node of a driving element, so that data charging capability can be improved even when a driving frequency is increased.

According to the present disclosure, a dual data charging control is possible by adjusting a falling time of a scan pulse applied to two switch elements, and thus a data charging rate can be improved.

The effects of the present disclosure are not limited to the above-mentioned effects, and other effects that are not mentioned will be apparently understood by those skilled in the art from the following description and the appended claims.

BRIEF DESCRIPTION OF THE DRAWINGS

The above and other objects, features, and advantages of the present disclosure will become more apparent to those of ordinary skill in the art by describing exemplary embodiments thereof in detail with reference to the attached drawings, in which.

DETAILED DESCRIPTION

Figure 1:
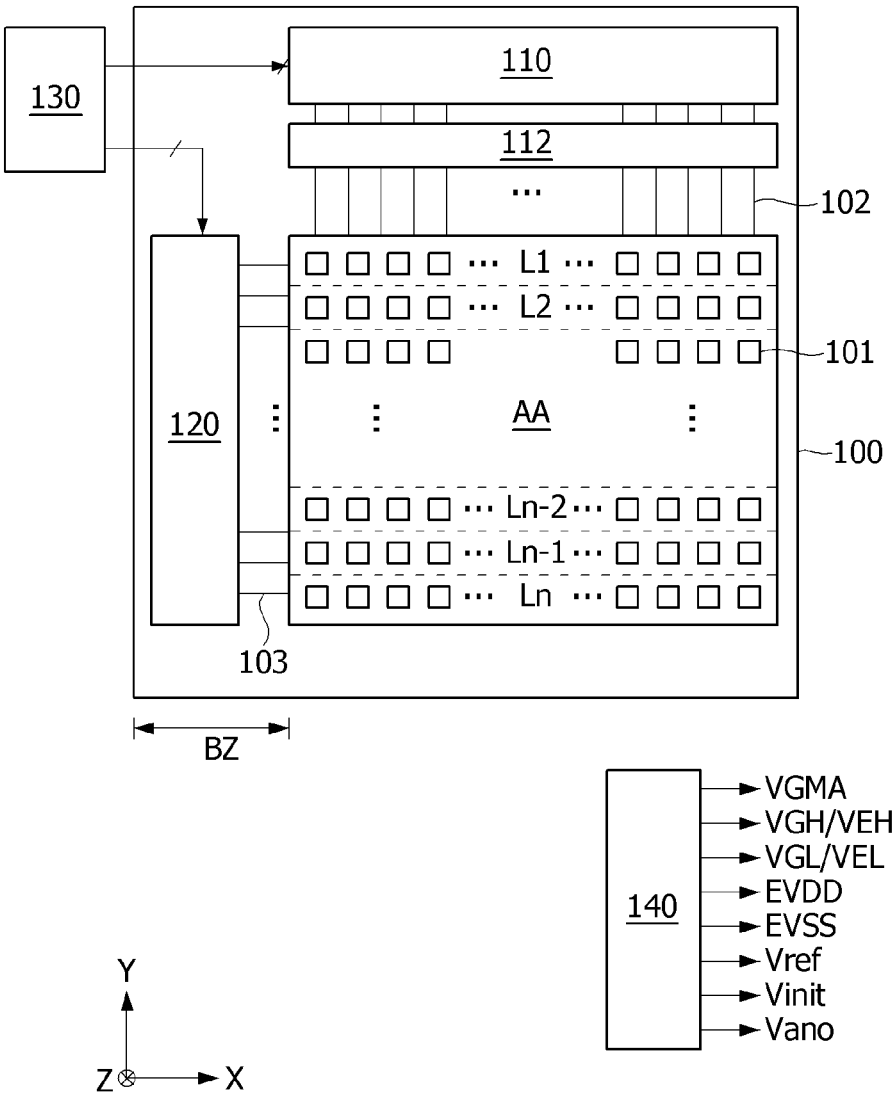
FIG. 1 is a block diagram illustrating a display device according to an embodiment of the present disclosure.

The advantages and features of the present disclosure and methods for accomplishing the same will be more clearly understood from embodiments described below with reference to the accompanying drawings. However, the present disclosure is not limited to the following embodiments but may be implemented in various different forms. Rather, the present embodiments will make the disclosure of the present disclosure complete and allow those skilled in the art to completely comprehend the scope of the present disclosure. The present disclosure is only defined within the scope of the accompanying claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies may be omitted to avoid unnecessarily obscuring the subject matter of the present disclosure.

The terms such as "comprising," "including," and "having" used herein are generally intended to allow other components to be added unless the terms are used with the term "only." Any references to singular may include plural unless expressly stated otherwise.

Components are interpreted to include an ordinary error range even if not expressly stated.

When the position relation between two components is described using the terms such as "on," "above," "below," and "next," one or more components may be positioned between the two components unless the terms are used with the term "immediately" or "directly."

The terms "first," "second," and the like may be used to distinguish components from each other, but the functions or structures of the components are not limited by ordinal numbers or component names in front of the components.

The same reference numerals may refer to substantially the same elements throughout the present disclosure.

The following embodiments can be partially or entirely bonded to or combined with each other and can be linked and operated in technically various ways. The embodiments can be carried out independently of or in association with each other.

Hereinafter, various embodiments of the present disclosure will be described in detail with reference to the accompanying drawings.

Each of pixels is divided into a plurality of sub-pixels having different colors to implement color, and each of the sub-pixels includes a transistor used as a switch element or a driving element. Such a transistor may be implemented as a thin film transistor (TFT).

A driving circuit of a display device writes pixel data of an input image to pixels. A driving circuit of a flat panel display device includes a data driver for supplying a data signal to data lines, a gate driver for supplying a gate signal to gate lines, and the like.

In a display device of the present disclosure, a pixel circuit may include a plurality of transistors. The transistor may be implemented as a TFT having a metal-oxide-semiconductor FET (MOSFET) structure, and may be an oxide TFT including an oxide semiconductor or an LTPS TFT including a low temperature polysilicon (LTPS).

Hereinafter, transistors constituting the pixel circuit will be described exemplarily using an example implemented with an n-channel oxide TFT, but the present disclosure is not limited thereto.

A transistor is a three-electrode device including a gate, a source, and a drain. The source is an electrode that supplies a carrier to the transistor. In the transistor, carriers begin to flow from the source. The drain is an electrode through which carriers exit the transistor. In the transistor, a carrier flows from the source to the drain. In case of an n-channel transistor, because the carrier is an electron, the source voltage is lower (e.g., less) than the drain voltage so that electrons can flow from the source to the drain. In the n-channel transistor, the direction of current is from the drain to the source. In case of a p-channel transistor, because the carrier is a hole, the source voltage is higher (e.g., greater) than the drain voltage so that holes can flow from the source to the drain. In the p-channel transistor, current flows from the source to the drain because holes flow from the source to the drain. It should be noted that the source and the drain are not fixed in the transistor. For example, the source and the drain may be changed according to an applied voltage. Thus, the disclosure is not limited by the source and drain of the transistor. In the following description, the source and drain of the transistor will be referred to as first and second electrodes.

A gate signal may swing between a gate-on voltage and a gate-off voltage. The gate-on voltage is set to a voltage higher than the threshold voltage of the transistor. The gate-off voltage is set to a voltage lower than the threshold voltage of the transistor.

The transistor is turned on in response to the gate-on voltage and turned off in response to the gate-off voltage. In case of an n-channel transistor, the gate-on voltage may be a gate high voltage (VGH and VEH), and the gate-off voltage may be a gate low voltage (VGL and VEL).

Hereinafter, various embodiments of the present disclosure will be described in detail with reference to the accompanying drawings. In the following embodiments, the display device will be described focusing an organic light emitting display device, but the disclosure invention is not limited thereto.

Figure 2:
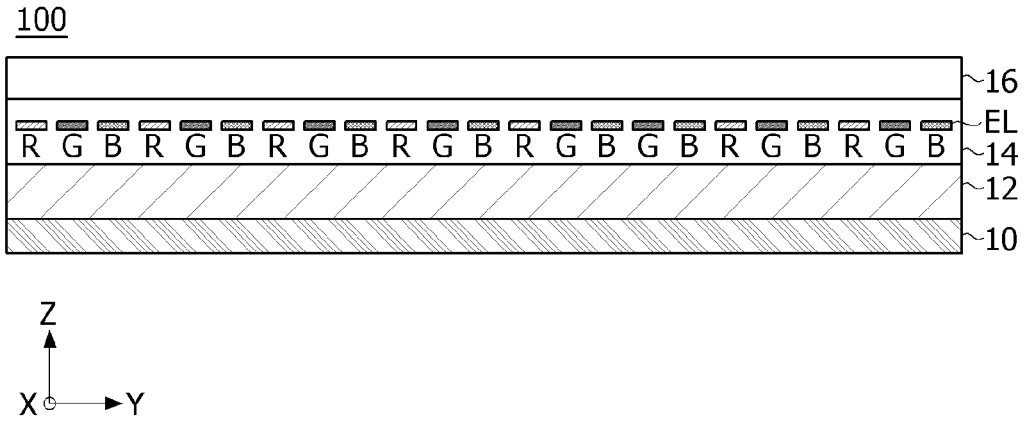
FIG. 2 is a diagram illustrating a cross-sectional structure of the display panel shown in FIG. 1 according to an embodiment of the present disclosure.

FIG. 1 is a block diagram illustrating a display device according to an embodiment of the present disclosure, and FIG. 2 is a diagram illustrating a cross-sectional structure of the display panel shown in FIG. 1 according to an embodiment of the present disclosure.

Referring to FIGS. 1 and 2, the display device according to an embodiment of the present disclosure includes a display panel 100, a display panel driver for writing pixel data to pixels of the display panel 100, and a power supply 140 for generating power necessary for driving the pixels and the display panel driver.

The display panel 100 may be a display panel having a rectangular structure having a length in an X-axis direction, a width in a Y-axis direction, and a thickness in a Z-axis direction. The display panel 100 includes a pixel array AA that displays an input image. The pixel array AA includes a plurality of data lines 102, a plurality of gate lines 103 that intersect with the data lines 102, and pixels 101 arranged in a matrix form. The display panel 100 may further include power lines commonly connected to pixels. The power lines may include a power line to which a pixel driving voltage EVDD is applied, a power line to which an initialization voltage Vinit is applied, a power line to which a reference voltage Vref is applied, and a power line to which a low potential power voltage EVSS is applied. These power lines are commonly connected to the pixels.

The pixel array AA includes a plurality of pixel lines L1 to Ln. Each of the pixel lines L1 to Ln includes one line of pixels arranged along a line direction X in the pixel array AA of the display panel 100. Pixels arranged in one pixel line share a same gate line 103. Sub-pixels arranged in a column direction Y along a data line direction share the same data line 102. One horizontal period 1H is a time obtained by dividing one frame period by the total number of pixel lines L1 to Ln.

The display panel 100 may be implemented as a non-transmissive display panel or a transmissive display panel. The transmissive display panel may be applied to a transparent display device in which an image is displayed on a screen and an actual background may be seen.

The display panel 100 may be implemented as a flexible display panel. The flexible display panel may be made of a plastic OLED panel. An organic thin film may be disposed on a back plate of the plastic OLED panel, and the pixel array AA and light emitting element may be formed on the organic thin film.

To implement color, each of the pixels 101 may be divided into a red sub-pixel (hereinafter referred to as "R sub-pixel"), a green sub-pixel (hereinafter referred to as "G sub-pixel"), and a blue sub-pixel (hereinafter referred to as "B sub-pixel"). Each of the pixels 101 may further include a white sub-pixel. Each of the sub-pixels includes a pixel circuit. The pixel circuit is connected to the data line, the gate line and power line.

The pixels 101 may be arranged as real color pixels and pentile pixels. The pentile pixel may realize a higher resolution than the real color pixel by driving two sub-pixels having different colors as one pixel 101 using a preset pixel rendering algorithm. The pixel rendering algorithm may compensate for insufficient color representation in each pixel with a color of light emitted from an adjacent pixel.

Touch sensors may be disposed on the display panel 100. A touch input may be sensed using separate touch sensors or may be sensed through pixels. The touch sensors may be disposed as an on-cell type or an add-on type on the screen of the display panel or implemented as in-cell type touch sensors embedded in the pixel array AA.

As shown in FIG. 2, when viewed from a cross-sectional structure, the display panel 100 may include a circuit layer 12, a light emitting element layer 14, and an encapsulation layer 16 stacked on a substrate 10.

The circuit layer 12 may include a pixel circuit connected to wirings such as a data line, a gate line, and a power line, a gate driver (GIP) connected to the gate lines, and the like. The wirings and circuit elements of the circuit layer 12 may include a plurality of insulating layers, two or more metal layers separated with the insulating layer therebetween, and an active layer including a semiconductor material.

The light emitting element layer 14 may include a light emitting element EL driven by a pixel circuit. The light emitting element EL may include a red (R) light emitting element, a green (G) light emitting element, and a blue (B) light emitting element. The light emitting element layer 14 may include a white light emitting element and a color filter. The light emitting elements EL of the light emitting element layer 14 may be covered by a protective layer including an organic film and a passivation film.

The encapsulation layer 16 covers the light emitting element layer 14 to seal the circuit layer 12 and the light emitting element layer 14. The encapsulation layer 16 may have a multilayered insulating structure in which an organic film and an inorganic film are alternately stacked. The inorganic film blocks or at least reduces the penetration of moisture and oxygen. The organic film planarizes the surface of the inorganic film. When the organic film and the inorganic film are stacked in multiple layers, a movement path of moisture or oxygen becomes longer compared to a single layer, so that penetration of moisture and oxygen affecting the light emitting element layer 14 can be effectively blocked.

A touch sensor layer may be disposed on the encapsulation layer 16. The touch sensor layer may include capacitive type touch sensors that sense a touch input based on a change in capacitance before and after the touch input. The touch sensor layer may include metal wiring patterns and insulating layers forming the capacitance of the touch sensors. The capacitance of the touch sensor may be formed between the metal wiring patterns. A polarizing plate may be disposed on the touch sensor layer. The polarizing plate may improve visibility and contrast ratio by converting the polarization of external light reflected by metal of the touch sensor layer and the circuit layer 12. The polarizing plate may be implemented as a polarizing plate in which a linear polarizing plate and a phase delay film are bonded, or a circular polarizing plate. A cover glass may be adhered to the polarizing plate.

The display panel 100 may further include a touch sensor layer and a color filter layer stacked on the encapsulation layer 16. The color filter layer may include red, green, and blue color filters and a black matrix pattern. The color filter layer may replace the polarizing plate and increase the color purity by absorbing a part of the wavelength of light reflected from the circuit layer and the touch sensor layer. In this embodiment, by applying the color filter layer having a higher light transmittance than the polarizing plate to the display panel, the light transmittance of the display panel PNL can be improved, and the thickness and flexibility of the display panel PNL can be improved. A cover glass may be adhered on the color filter layer.

The power supply 140 generates direct current (DC) power required for driving the pixel array AA and the display panel driver of the display panel 100 by using a DC-DC converter. The DC-DC converter may include a charge pump, a regulator, a buck converter, a boost converter, and the like. The power supply 140 may adjust a DC input voltage from a host system (not shown) and thereby generate DC voltages such as a gamma reference voltage VGMA, gate-on voltages VGH and VEH, gate-off voltages VGL and VEL, a pixel driving voltage EVDD, a pixel low-potential power supply voltage EVSS, a reference voltage Vref, an initial voltage Vinit, an anode voltage Vano, and the like. The gamma reference voltage VGMA is supplied to a data driver 110. The gate-on voltages VGH and VEH and the gate-off voltages VGL and VEL are supplied to a gate driver 120. The pixel driving voltage EVDD and the pixel low-potential power supply voltage EVSS, a reference voltage Vref, an initial voltage Vinit, an anode voltage Vano, and the like are commonly supplied to the pixels.

The display panel driver writes pixel data (digital data) of an input image to the pixels of the display panel 100 under the control of a timing controller (TCON) 130.

The display panel driver includes the data driver 110 and the gate driver 120. A display panel driver may further include a data driver 110 and a demultiplexer array 112 disposed between data lines 102.

The demultiplexer array 112 sequentially supplies data voltages output from channels of the data driver 110 to the data lines 102 using a plurality of demultiplexers (DEMUXs). The demultiplexers may include a plurality of switch elements disposed on the display panel 100. When the demultiplexers are disposed between output terminals of the data driver 110 and the data lines 102, the number of channels of the data driver 110 may be reduced. The demultiplexer array 112 may be omitted.

The display panel driver may further include a touch sensor driver for driving the touch sensors. The touch sensor driver is omitted from FIG. 1. The touch sensor driver may be integrated into one drive integrated circuit (IC). In a mobile device or wearable device, the timing controller 130, the power supply 140, the data driver 110, the touch sensor driver, and the like may be integrated into one drive integrated circuit (IC).

A display panel driver may operate in a low-speed driving mode under the control of a timing controller (TCON) 130. The low-speed driving mode may be set to reduce power consumption of a display device when there is no change in an input image for a preset number of frames in analysis of the input image. In the low-speed driving mode, the power consumption of the display panel driver and a display panel 100 may be reduced by lowering a refresh rate of pixels when a still image is input for a predetermined time or longer. A low-speed driving mode is not limited to a case in which a still image is input. For example, when the display device operates in a standby mode or when a user command or an input image is not input to a display panel driver for a predetermined time or more, the display panel driver may operate in the low-speed driving mode.

The data driver 110 generates a data voltage Vdata by converting pixel data of an input image received from the timing controller 130 with a gamma compensation voltage every frame period by using a digital to analog converter (DAC). The gamma reference voltage VGMA is divided for respective gray scales through a voltage divider circuit. The gamma compensation voltage divided from the gamma reference voltage VGMA is provided to the DAC of the data driver 110. The data voltage Vdata is outputted through the output buffer AMP in each of the channels of the data driver 110.

The gate driver 120 may be implemented as a gate in panel (GIP) circuit formed directly on a circuit layer 12 of the display panel 100 together with the TFT array of the pixel array AA. The gate in panel (GIP) circuit may be disposed on a bezel area BZ that is a non-display area of the display panel 100 or dispersed in the pixel array on which an input image is reproduced. The gate driver 120 sequentially outputs gate signals to the gate lines 103 under the control of the timing controller 130. The gate driver 120 may sequentially supply the gate signals to the gate lines 103 by shifting the gate signals using a shift register. The gate signal may include scan pulses, emission control pulses (hereinafter referred to as "EM pulses"), initial pulses, and sensing pulses.

The shift register of the gate driver 120 outputs a pulse of the gate signal in response to a start pulse and a shift clock from the timing controller 130, and shifts the pulse according to the shift clock timing.

The timing controller 130 receives, from a host system (not shown), digital video data DATA of an input image and a timing signal synchronized therewith. The timing signal includes a vertical synchronization signal Vsync, a horizontal synchronization signal Hsync, a main clock CLK, a data enable signal DE, and the like. Because a vertical period and a horizontal period can be known by counting the data enable signal DE, the vertical synchronization signal Vsync and the horizontal synchronization signal Hsync may be omitted. The data enable signal DE has a cycle of one horizontal period (1H).

A host system may be any one of a television (TV) system, a tablet computer, notebook computer, a navigation system, a personal computer (PC), a home theater system, a mobile device, and a vehicle system. The host system may scale an image signal from a video source according to the resolution of the display panel 100 and transmit the image signal to a timing controller 130 together with the timing signal.

The timing controller 130 multiplies an input frame frequency by i and controls the operation timing of the display panel driver with a frame frequency of the input frame frequency×i (i is a positive integer greater than 0) Hz. The input frame frequency is 60 Hz in the National Television Standards Committee (NTSC) scheme and 50 Hz in the phase-alternating line (PAL) scheme. The timing controller 130 may lower a driving frequency of the display panel driver by lowering a frame frequency to a frequency between 1 Hz and 30 Hz to lower a refresh rate of pixels in the low-speed driving mode.

Based on the timing signals Vsync, Hsync, and DE received from the host system, the timing controller 130 generates a data timing control signal for controlling the operation timing of the data driver 110, a control signal for controlling the operation timing of the demultiplexer array 112, and a gate timing control signal for controlling the operation timing of the gate driver 120. The timing controller 130 controls an operation timing of the display panel driver to synchronize the data driver 110, the demultiplexer array 112, a touch sensor driver, and a gate driver 120.

The voltage level of the gate timing control signal outputted from the timing controller 130 may be converted into the gate-on voltages VGH and VEH and the gate-off voltages VGL and VEL through a level shifter (not shown) and then supplied to the gate driver 120. That is, the level shifter converts a low level voltage of the gate timing control signal into the gate-off voltages VGL and VEL and converts a high level voltage of the gate timing control signal into the gate-on voltages VGH and VEH. The gate timing signal includes the start pulse and the shift clock.

Figure 3:
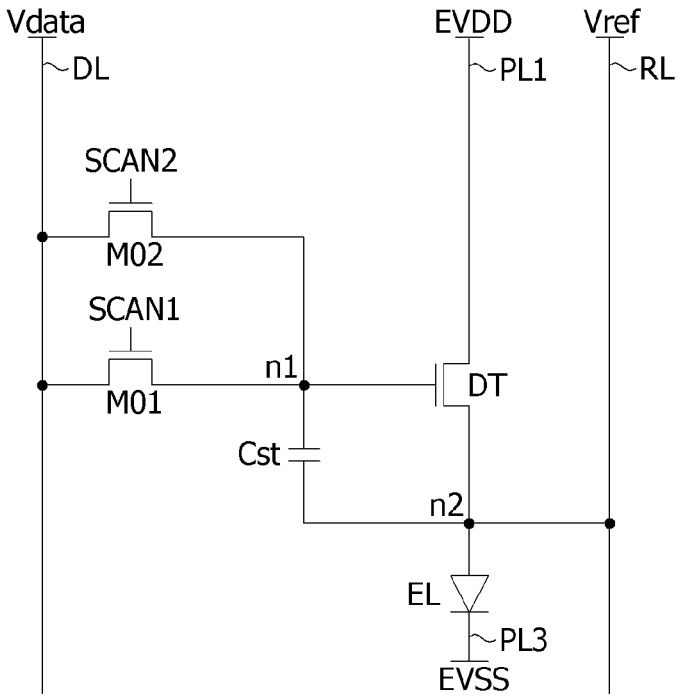
FIG. 3 is a circuit diagram illustrating a pixel circuit according to a first embodiment of the present disclosure.

FIG. 3 is a circuit diagram illustrating a pixel circuit according to a first embodiment of the present disclosure.

Referring to FIG. 3, the pixel circuit according to the first embodiment of the present disclosure may include a light emitting element EL, a driving element DT for driving the light emitting element EL, a plurality of switch elements M01 and M02, and a capacitor Cst.

The light-emitting element EL may be implemented as an OLED. The OLED includes an organic compound layer formed between an anode and a cathode. The organic compound layer may include a hole injection layer (HIL), a hole transport layer (HTL), a light-emitting layer (EML), an electron transport layer (ETL), an electron injection layer (EIL), and the like, but is not limited thereto. An anode electrode of the light emitting element EL is connected to a second node n2, and a cathode electrode is connected to a third power line PL3 to which a low potential power voltage EVSS is applied. When a voltage is applied to the anode and cathode electrodes of the light emitting element EL, holes passing through a hole transport layer HTL and electrons passing through an electron transport layer ETL are moved to an emission layer EML and form exciton, which thereby emits visible light in the emission layer EML.

An organic light emitting diode used as the light emitting element may have a tandem structure in which a plurality of light emitting layers are stacked. The organic light emitting diode having the tandem structure may improve the luminance and lifespan of the pixel.

The driving element DT generates a current according to a gate-source voltage Vgs and thereby drives the light emitting element EL. The driving element DT includes a gate electrode connected to a first node n1, a first electrode connected to a first power line PL1 to which a pixel driving voltage EVDD is applied, and a second electrode connected to the second node n2.

The first switch element M01 is turned on according to a gate-on voltage VEH of a first scan pulse SCAN1 and applies a data voltage to the first node n1. The first switch element M01 includes a gate electrode to which the first scan pulse SCAN1 is applied, a first electrode connected to a second power line DL to which a data voltage Vdata is applied, and a second electrode connected to the first node n1.

The second switch element M02 is turned on according to a gate-on voltage VEH of a second scan pulse SCAN2 and applies the data voltage to the first node n1. The second switch element M02 includes a gate electrode to which the second scan pulse SCAN2 is applied, a first electrode connected to the second power line DL to which the data voltage is applied, and a second electrode connected to the first node n1.

In case that both the first switch element M01 and the second switch element M02 are turned on during a period in which the data voltage is applied, the first switch element M01 and the second switch element M02 are connected in parallel to the second power line DL. This reduces the overall resistance on the equivalent circuit, thereby improving the data charging capability.

The first capacitor Cst is connected between the first node n1 and the second node n2 and stores a threshold voltage. One end of the first capacitor Cst is connected to the first node n1, and the other end is connected to the second node n2.

Figure 4:
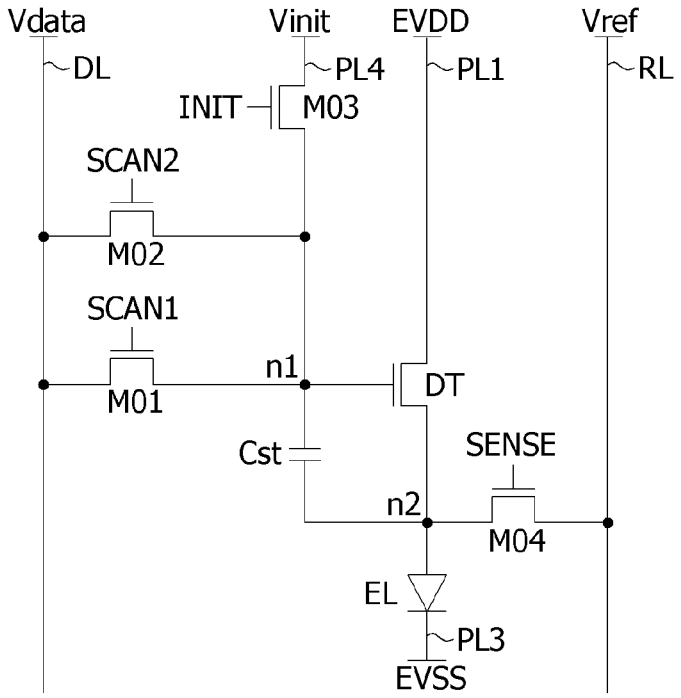
FIG. 4 is a circuit diagram illustrating a pixel circuit according to a second embodiment of the present disclosure.
Figure 5A:
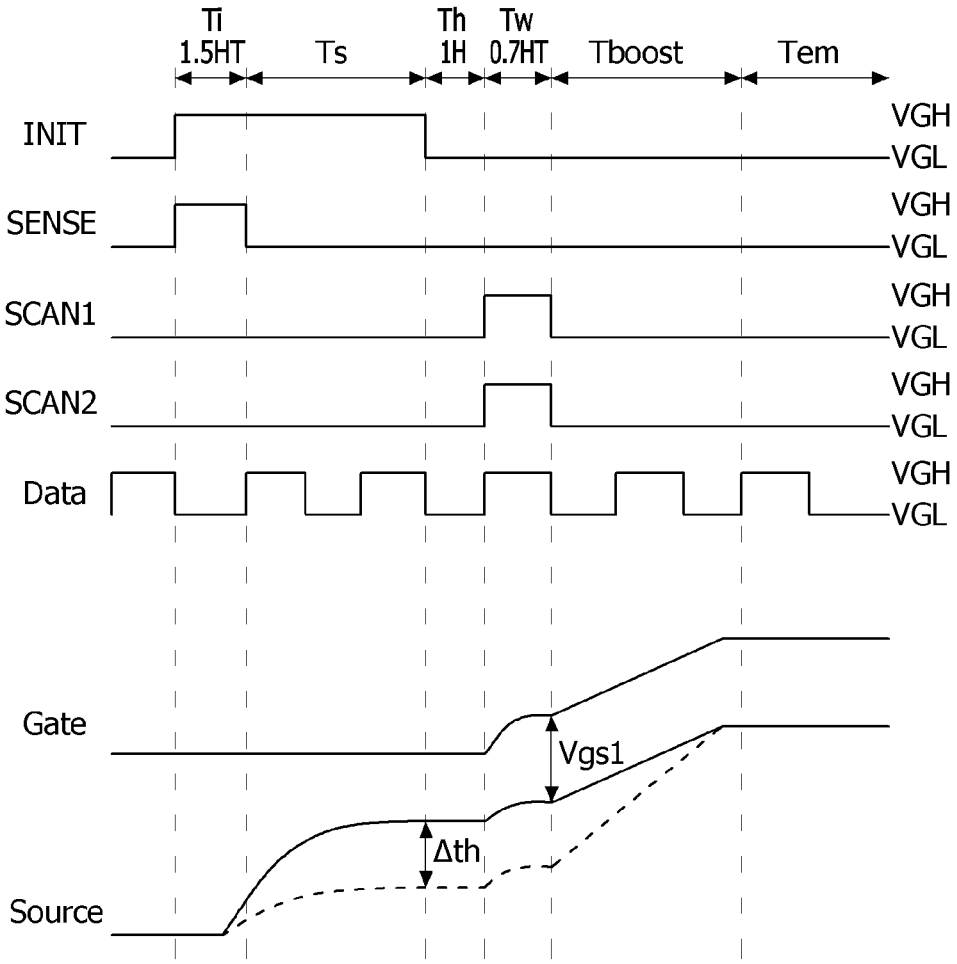
FIGS. 5A and 5B are waveform diagrams illustrating a gate signal applied to the pixel circuit shown in FIG. 4 according to the second embodiment of the present disclosure.
Figure 5B:
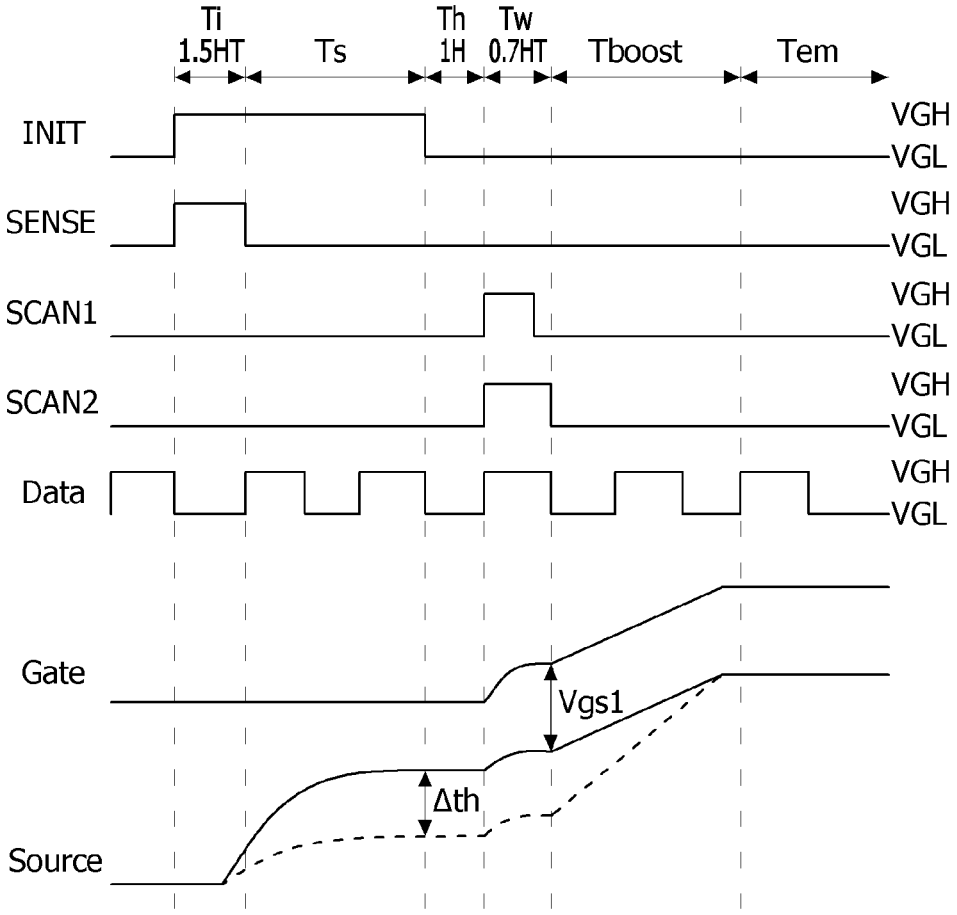

FIG. 4 is a circuit diagram illustrating a pixel circuit according to a second embodiment of the present disclosure, and FIGS. 5A and 5B are waveform diagrams illustrating a gate signal applied to the pixel circuit shown in FIG. 4 according to the second embodiment of the present disclosure.

Referring to FIG. 4, the pixel circuit according to the second embodiment of the present disclosure may include a light emitting element EL, a driving element DT for driving the light emitting element EL, a plurality of switch elements M01 M02, M03, and M04, and a capacitor Cst. The driving element DT and the switch elements M01 M02, M03 and M04 may be implemented as n-channel oxide TFTs.

This pixel circuit is connected to a first power line PL1 to which a pixel driving voltage EVDD is applied, a second power line DL to which a data voltage Vdata is applied, a third power line PL3 to which a low potential power voltage EVSS is applied, a fourth power line PL4 to which an initialization voltage Vinit is applied, a fifth power line RL to which a reference voltage Vref is applied, and gate lines to which gate signals INIT, SENSE, SCAN1 and SCAN2 are applied.

The driving element DT generates a current according to a gate-source voltage Vgs and thereby drives the light emitting element EL. The driving element DT includes a gate electrode connected to a first node n1, a first electrode connected to the first power line PL1 to which the pixel driving voltage EVDD is applied, and a second electrode connected to a second node n2.

The first switch element M01 is turned on according to a gate-on voltage VEH of a first scan pulse SCAN1 and applies a data voltage to the first node n1. The first switch element M01 includes a gate electrode to which the first scan pulse SCAN1 is applied, a first electrode connected to the second power line DL to which the data voltage is applied, and a second electrode connected to the first node n1.

The second switch element M02 is turned on according to a gate-on voltage VEH of a second scan pulse SCAN2 and applies the data voltage to the first node n1. The second switch element M02 includes a gate electrode to which the second scan pulse SCAN2 is applied, a first electrode connected to the second power line DL to which the data voltage is applied, and a second electrode connected to the first node n1.

The third switch element M03 is turned on according to a gate-on voltage VGH of an initialization pulse INIT and applies the initialization voltage Vinit to the first node n1. The third switch element M03 includes a first electrode connected to the fourth power line PL4 to which the initialization voltage Vinit is applied, a gate electrode to which the initialization pulse INIT is applied, and a second electrode connected to the first node n1.

The fourth switch element M04 is turned on according to a gate-on voltage VGH of a sensing pulse SENSE and supplies the reference voltage Vref to the second node n2. The fourth switch element M04 includes a first electrode connected to the second node n2, a gate electrode to which the sensing pulse SENSE is applied, and a second electrode connected to the fifth power line RL to which the reference voltage is applied.

As shown in FIGS. 5A and 5B, the pixel circuit may be driven in the order of an initialization period Ti, a sensing period Ts, a data writing period Tw, and a light emission period Tem. In the initialization period Ti, the pixel circuit is initialized. In the sensing period Ts, a threshold voltage Vth of the driving element DT is sensed and stored in the first capacitor Cst. In the data writing period Tw, the data voltage Vdata of pixel data is applied to the first node n1. After the voltages at the first and second nodes n1 and n2 are increased in a boosting period Tboost, the light emitting element EL can emit light with a luminance corresponding to a gray scale value of the pixel data in the light emission period Tem.

The pixel circuit may equally apply the first scan pulse and the second scan pulse as shown in FIG. 5A, and may differently and separately apply the first scan pulse and the second scan pulse as shown in FIG. 5B.

FIGS. 6A to 6D are circuit diagrams illustrating the operation of the pixel circuit shown in FIG. 4 in stages according to the second embodiment. Here, the operation according to the driving timing as shown in FIG. 5B will be described.

Figure 6A:
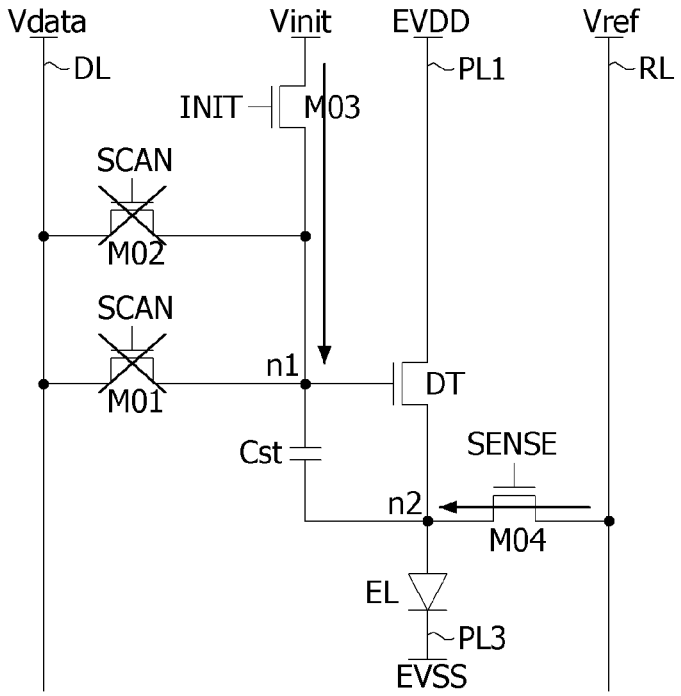
FIGS. 6A to 6D are circuit diagrams illustrating the operation of the pixel circuit shown in FIG. 4 in stages according to the second embodiment of the present disclosure.

As shown in FIG. 6A, in the initialization period Ti, the third and fourth switch elements M03 and M04 are turned on, and the first and second switch elements M01 and M02 are turned off. The initialization voltage Vinit is applied to the first node n1, and the reference voltage Vref is applied to the second node n2. At this time, the driving element DT is turned on, and the light emitting element EL is not turned on.

Figure 6B:
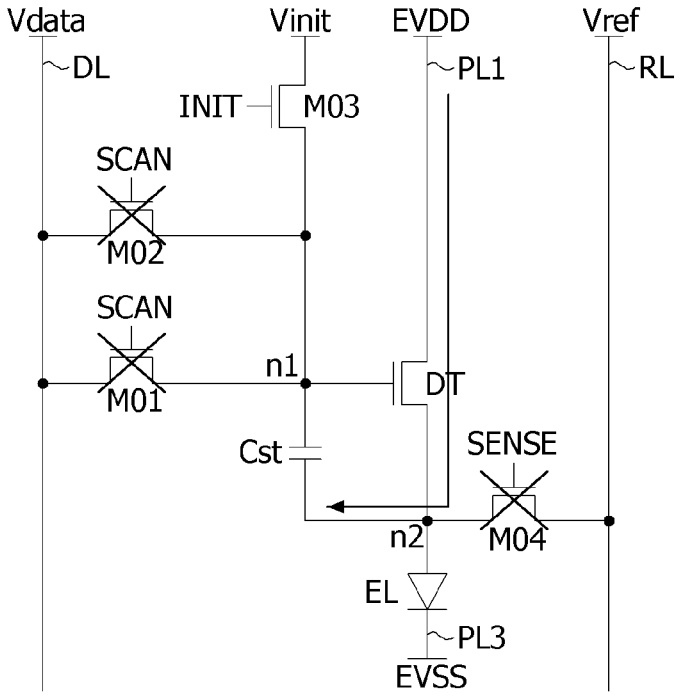

As shown in FIG. 6B, in the sensing period Ts, the fourth switch element M04 maintains the turned-on state and thus the voltage of the second node n2 increases. When the gate-source voltage Vgs of the driving element DT reaches the threshold voltage Vth, the driving element DT is turned off and the threshold voltage Vth is stored in the first capacitor Cst. During the sensing period Ts, the sensing pulse SENSE applied to the fourth switch element M04 may be generated for approximately 1.5 horizontal period (1.5H).

In a hold period Th, the third switch element M03 is turned off, and the second node n2 and the first node n1 are floated to maintain the previous voltage. The hold period Th may be generated for approximately one horizontal period (1H).

Figure 6C:
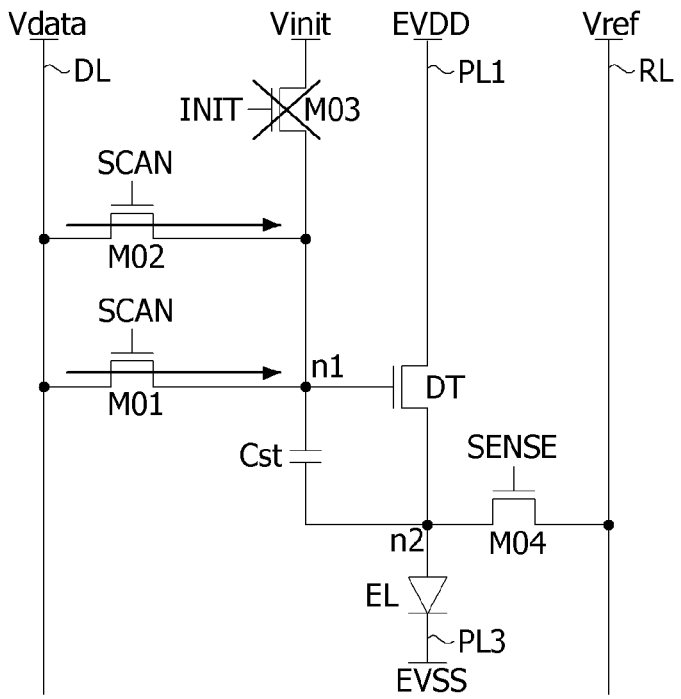

As shown in FIG. 6C, in the data writing period Tw, the first and second switch elements M01 and M02 are turned on. The data voltage Vdata of the pixel data is applied to the first node n1, and thus the voltage at the first node n1 is changed by the data voltage Vdata. At this time, the data voltage Vdata of the pixel data is not applied through one switch element, but applied through the first and second switch elements M01 and M02 connected in parallel, thereby improving charging characteristics. Both the first and second switch elements M01 and M02 maintain the turned-on state during the data writing step Tw. The scan pulse SCAN applied to the first and second switch elements M01 and M02 during the data writing step Tw may be generated for about 0.7 horizontal period (0.7H). The first and second switch elements M01 and M02 are both turned on when the data writing step Tw starts, whereas the first and second switch elements M01 and M02 are turned off at different time points. That is, the first switch element M01 is turned off before the data writing period Tw is terminated, and the second switch element M02 is turned off when the data writing period Tw is terminated. The reason why the turn-off time points are different as above is to prevent or at least reduce data shuffling. In this case, the time point at which the first switch element M01 is turned-off may be fixed, and the time point at which the second switch element M02 is turned-off may be variable.

In addition, the second scan pulse may not only reduce a falling time point, but also reduce a falling time by applying the under-driving downwards.

FIGS. 7A to 7G are diagrams illustrating a falling time of a second scan pulse according to one embodiment.

Figure 7A:
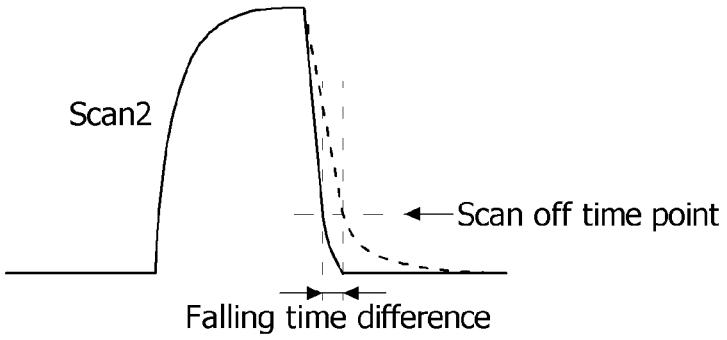
FIGS. 7A to 7G are diagrams describing a falling time of a second scan pulse according to an embodiment of the present disclosure.
Figure 7B:
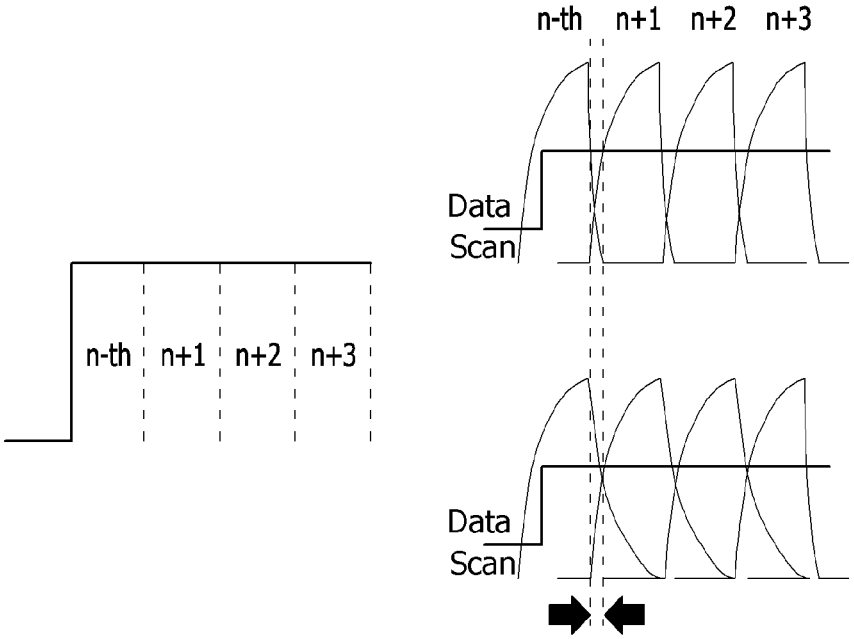

Referring to FIGS. 7A and 7B, it can be seen that when the falling time of the second scan pulse is changed, the turn-off time of the second switch element is also changed. As the falling time of the second scan pulse decreases, the turn-off time of the second switch element is reduced.

Due to the reduction in the turn-off time of the second switch element, it is possible to turn off the second switch element before the next line is opened. This makes it possible to prevent or at least reduce the occurrence of data shuffling, thereby securing a more effective charging time.

The second switch element is an auxiliary TFT for improving a charging rate and is capable of, compared to the first switch element, reducing the falling time by reducing the size and load and applying the under-driving downwards.

Figure 7C:
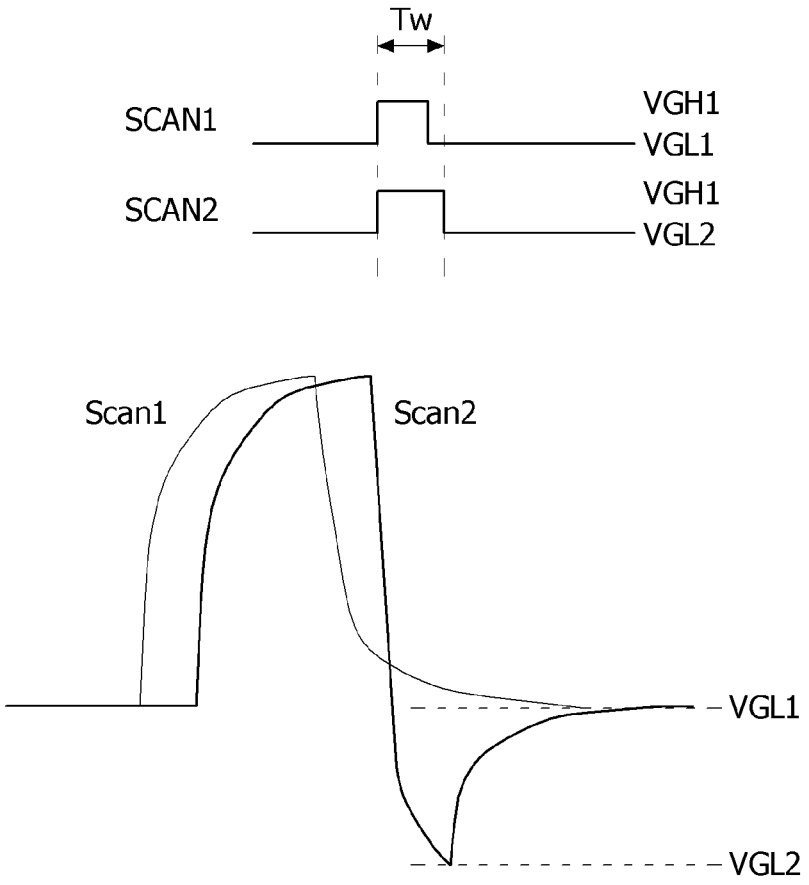

Referring to FIG. 7C, voltage levels of the first scan pulse SCAN1 and the second scan pulse SCAN2 can be separated, and the gate low voltage of the second scan pulse SCAN2 may be lower than the gate low voltage of the first scan pulse SCAN1. That is, the voltage of the first scan pulse SCAN1 swings between the first gate-on voltage VGH1 and the first gate-off voltage VGL1, and the voltage of the second scan pulse SCAN2 swings between the first gate-on voltage VGH1 and the second gate-off voltage VGL2 lower than the first gate-off voltage VGL1.

When a difference between the gate high voltage VGH1 and the gate low voltage VGL2 of the second scan pulse SCAN2 is increased, a falling period of the second scan pulse SCAN2 is shortened, and thus the falling time can be reduced.

Figure 7D:
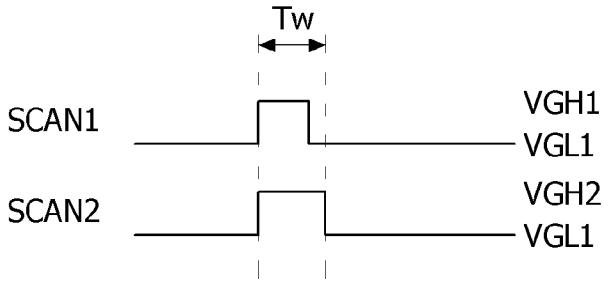

Referring to FIG. 7D, voltage levels of the first scan pulse SCAN1 and the second scan pulse SCAN2 can be separated, and the gate high voltage of the second scan pulse SCAN2 may be higher than the gate high voltage of the first scan pulse SCAN1. That is, the voltage of the first scan pulse SCAN1 swings between the first gate-on voltage VGH1 and the first gate-off voltage VGL1, and the voltage of the second scan pulse SCAN2 swings between the second gate-on voltage VGH2 higher than the first gate-on voltage VGH1 and the first gate-off voltage VGL1.

When a difference between the gate on voltage VGH2 and the gate off voltage VGL1 of the second scan pulse SCAN2 is increased, a falling period of the second scan pulse SCAN2 is shortened, and thus the falling time can be reduced.

Figure 7E:
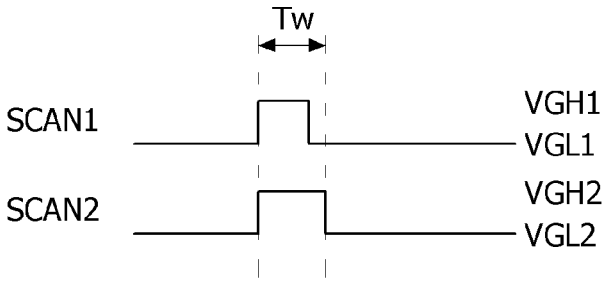

Referring to FIG. 7E, voltage levels of the first scan pulse SCAN1 and the second scan pulse SCAN2 can be separated, the gate low voltage of the second scan pulse SCAN2 may be lower than the gate low voltage of the first scan pulse SCAN1, and the gate high voltage of the second scan pulse SCAN2 may be higher than the gate high voltage of the first scan pulse SCAN1. That is, the voltage of the first scan pulse SCAN1 swings between the first gate-on voltage VGH1 and the first gate-off voltage VGL1, and the voltage of the second scan pulse SCAN2 swings between the second gate-on voltage VGH2 higher than the first gate-on voltage VGH1 and the second gate-off voltage VGL2 lower than the first gate-off voltage VGL1.

When a difference between the gate high voltage VGH2 and the gate low voltage VGL2 of the second scan pulse SCAN2 is increased, a falling period of the second scan pulse SCAN2 is shortened, and thus the falling time can be reduced.

Figure 7F:
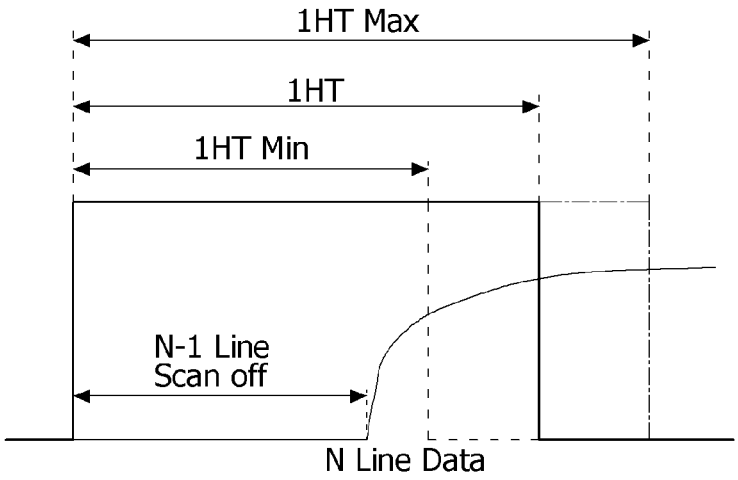

Referring to FIG. 7F, because the falling time of the scan pulse of the (n−1)-th line is shortened and thereby the turn-off time point of the switch element is advanced, the effective charging time in the n-th line is increased and thus the data charging rate can be improved.

Figure 7G:
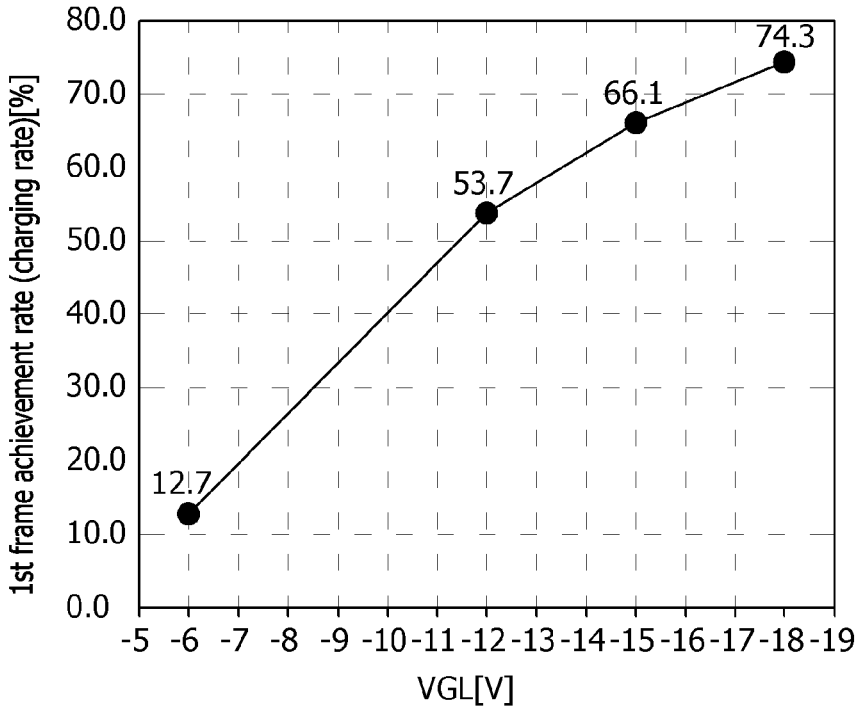

Referring to FIG. 7G, as the gate low voltage VGL of the second scan pulse is lowered, a difference from the gate high voltage VGH of the second scan pulse is increased. Therefore, the falling period of the second scan pulse is reduced and thereby the data charging rate can be improved.

For example, as shown, the data charging rate is 12.7% when the gate low voltage VGL of the second scan pulse is −6V, and the data charging rate is 53.7% when the gate low voltage VGL is −12V. Also, the data charging rate is 66.1% when the gate low voltage VGL is −15V, and the data charging rate is 74.3% when the gate low voltage VGL is −18V. This example shows that the charging rate is improved.

During the boosting period Tboost, the first, second, third, and fourth switch elements M01, M02, M03, and M04 are turned off. At this time, the voltages at the first and second nodes n1 and n2 are increased.

Figure 6D:
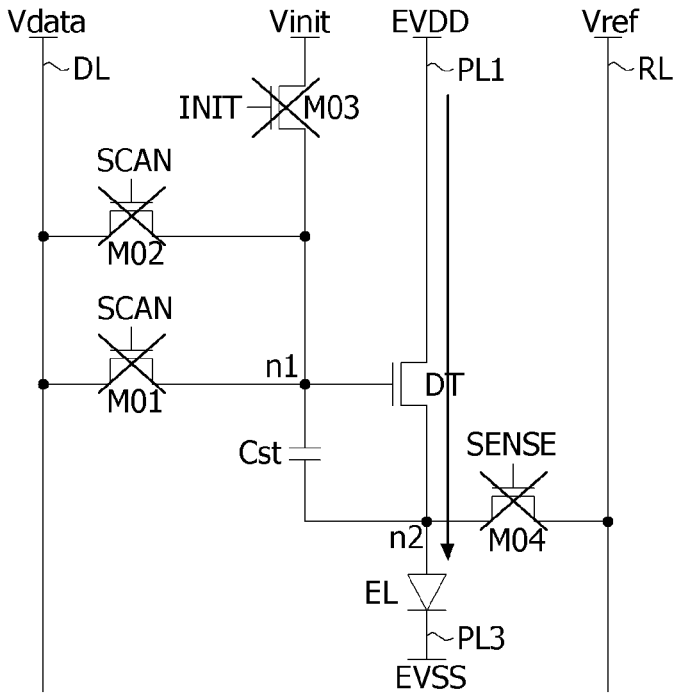

In the light emission period Tem, as shown in FIG. 6D, the first, second, third, and fourth switch elements M01, M02, M03, and M04 maintain the turned-off state. At this time, a current generated according to the gate-source voltage Vgs of the driving element DT, that is, the voltage between the first and second nodes n1 and n2, is supplied to the light emitting element EL, thereby causing the light emitting element EL to be emitted.

In embodiments, a case where the falling time of the scan pulse is equally applied to all pixels is exemplarily described, but the present disclosure is not limited thereto. That is, in embodiments, the falling time of the scan pulse is applied differently for each gate line or each gate line group in consideration of the RC delay in the data line or the IR drop in the power lines EVDD and EVSS.

Figure 8A:
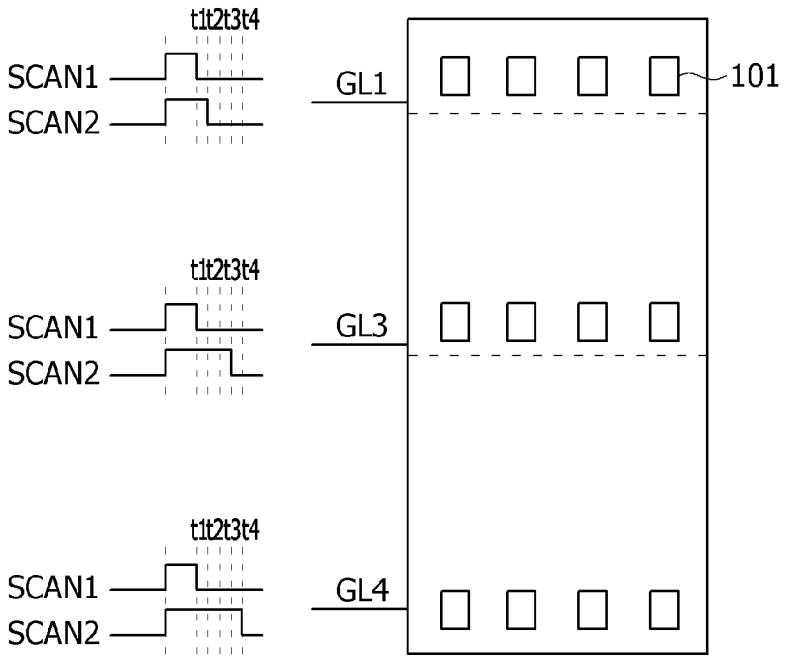
FIGS. 8A to 8C are waveform diagrams illustrating a gate signal applied to the pixel circuit shown in FIG. 4 according to the second embodiment of the present disclosure.
Figure 8B:
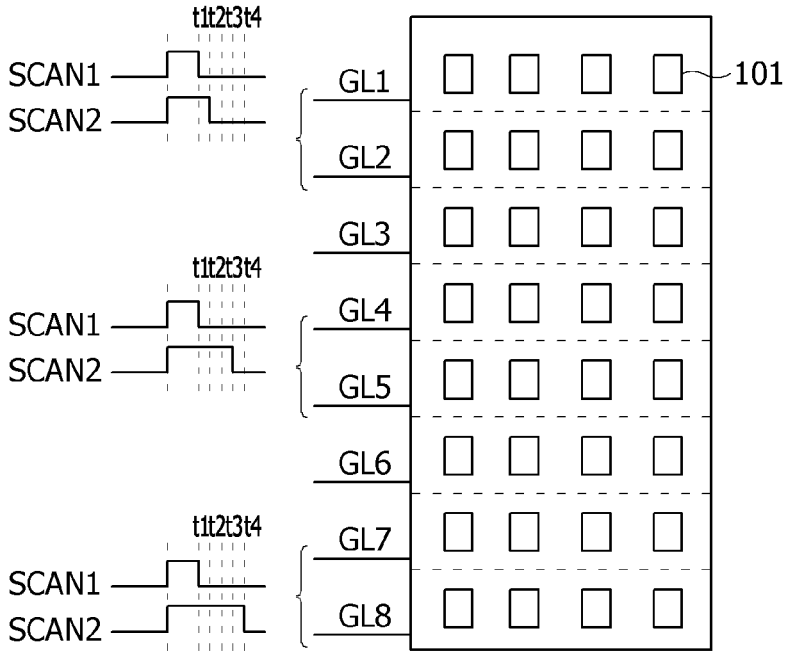
Figure 8C:
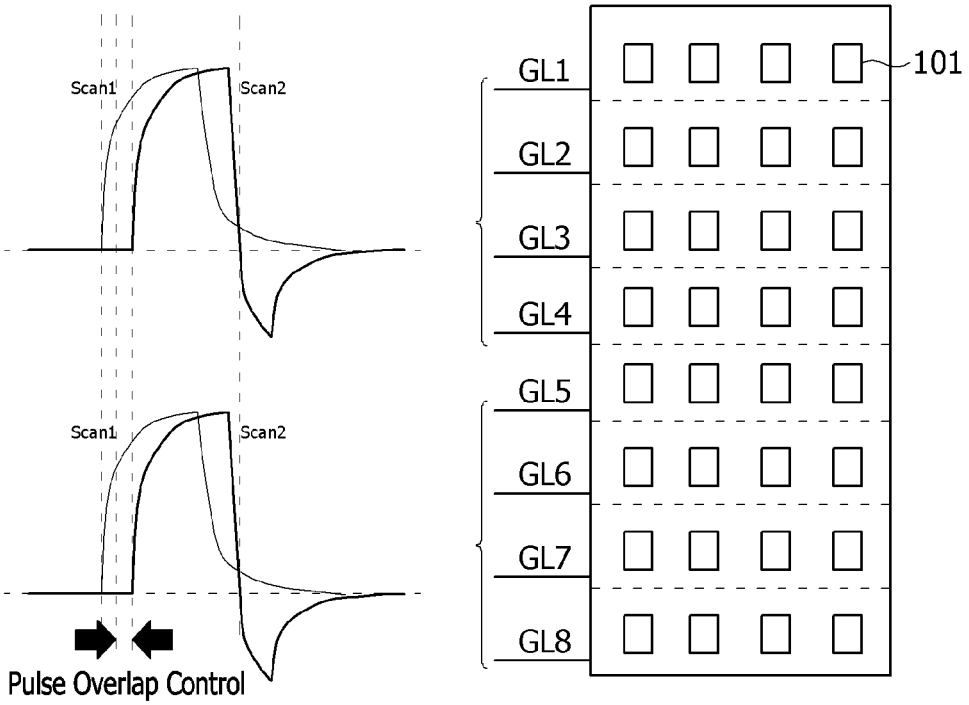

FIGS. 8A to 8C are waveform diagrams illustrating a gate signal applied to the pixel circuit shown in FIG. 4 according to the second embodiment.

Referring to FIG. 8A, in consideration of the resistor-capacitor (RC) delay in the data line or the current-resistor (IR) drop in the power lines EVDD and EVSS, the falling time of the second scan pulse may be applied differently for each gate line.

Referring to FIG. 8B, in consideration of the RC delay in the data line or the IR drop in the power lines EVDD and EVSS, the falling time of the second scan pulse may be applied differently for each gate line group.

Referring to FIG. 8C, in consideration of the RC delay in the data line or the IR drop in the power lines EVDD and EVSS, the rising time of the second scan pulse may be applied differently for each gate line group, thereby adjusting an overlapping period of the first scan pulse and the second scan pulse.

As shown in FIGS. 8A to 8C, the falling time or gate low voltage of the second scan pulse according to embodiments may vary in proportion to the RC delay or the IR drop.

Although a case where the gate low voltage of the second scan pulse is applied differently is described, the present disclosure is not limited thereto. That is, in embodiments, at least one of the gate high voltage and gate low voltage of the second scan pulse may be applied differently.

Figure 9:
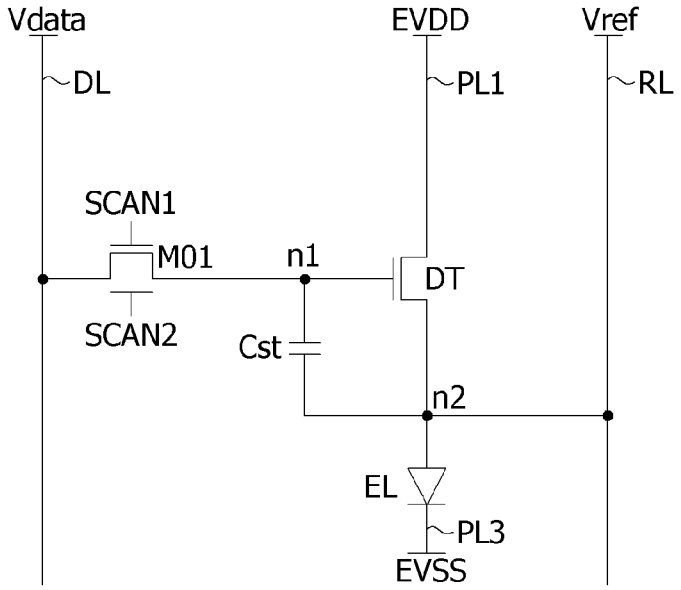
FIG. 9 is a circuit diagram illustrating a pixel circuit according to a third embodiment of the present disclosure.

FIG. 9 is a circuit diagram illustrating a pixel circuit according to a third embodiment of the present disclosure.

Referring to FIG. 9, the pixel circuit according to the third embodiment of the present disclosure includes a light emitting element EL, a driving element DT for driving the light emitting element EL, a switch element M01, and a capacitor Cst.

The light emitting element EL may be implemented as an OLED. The OLED includes an organic compound layer formed between an anode electrode and a cathode electrode. The organic compound layer may include, but is not limited to, a hole injection layer (HIL), a hole transport layer (HTL), an emission layer (EML), an electron transport layer (ETL), and an electron injection layer (EIL). The anode electrode of the light emitting element EL is connected to a second node n2, and the cathode electrode is connected to a third power line PL3 to which a low potential power voltage EVSS is applied. When a voltage is applied to the anode and cathode electrodes of the light emitting element EL, holes passing through the hole transport layer (HTL) and electrons passing through the electron transport layer (ETL) are moved to the emission layer (EML) and form exciton, which thereby emits visible light in the emission layer (EML).

The driving element DT generates a current according to a gate-source voltage Vgs and thereby drives the light emitting element EL. The driving element DT includes a gate electrode connected to a first node n1, a first electrode connected to a first power line to which a pixel driving voltage is applied, and a second electrode connected to the second node n2.

The first switch element M01 may be formed as a double gate and separately driven by a first scan pulse SCAN1 and a second scan pulse SCAN2 in one embodiment. In case of being formed as a double gate, applying a gate voltage to upper and lower surfaces of an active layer may result in an increase in carriers and increase in mobility, thereby improving current capability. Therefore, in case that the first switch element M01 is turned on during a period in which a data voltage is applied, data charging capability can be improved due to the current capability characteristic of the first switch element M01 having the double gate structure.

The first capacitor Cst is connected between the first node n1 and the second node n2 and stores a threshold voltage. One end of the first capacitor Cst is connected to the first node n1, and the other end is connected to the second node n2.

Figure 10:
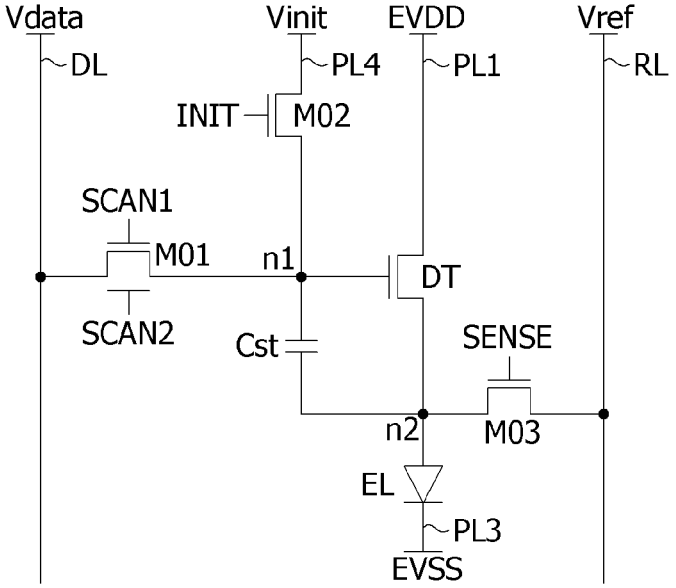
FIG. 10 is a circuit diagram illustrating a pixel circuit according to a fourth embodiment of the present disclosure.
Figure 11A:
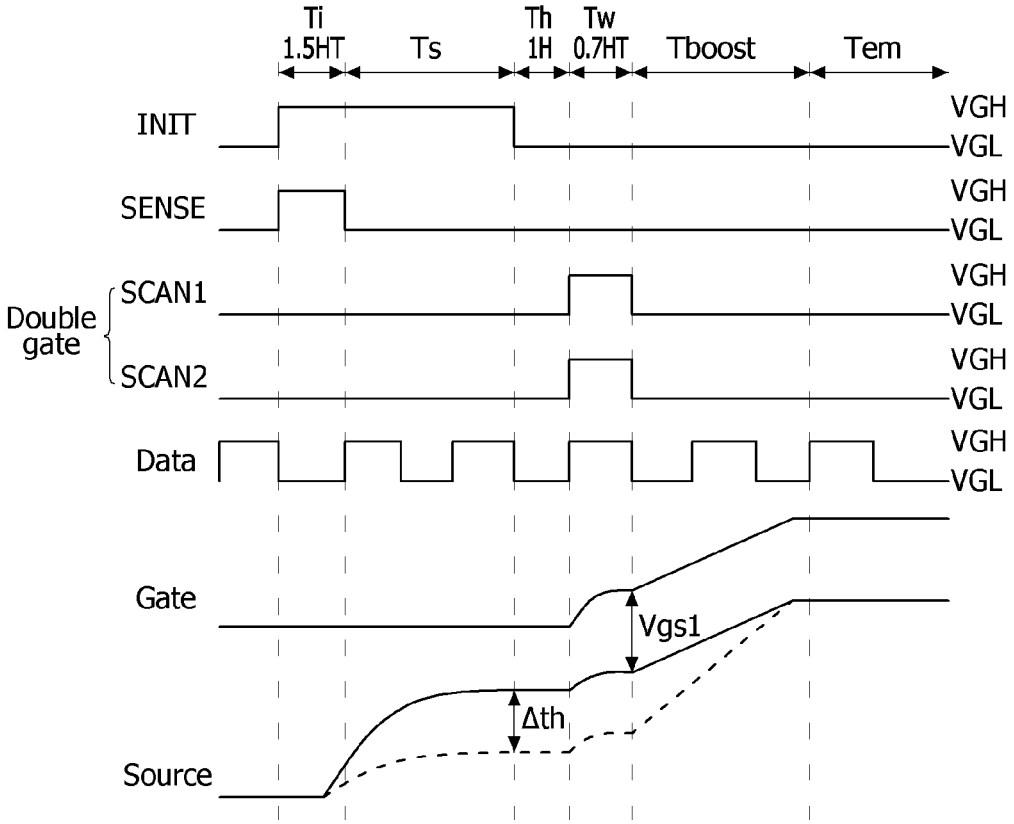
FIGS. 11A and 11B are waveform diagrams illustrating a gate signal applied to the pixel circuit shown in FIG. 10 according to the fourth embodiment of the present disclosure.
Figure 11B:
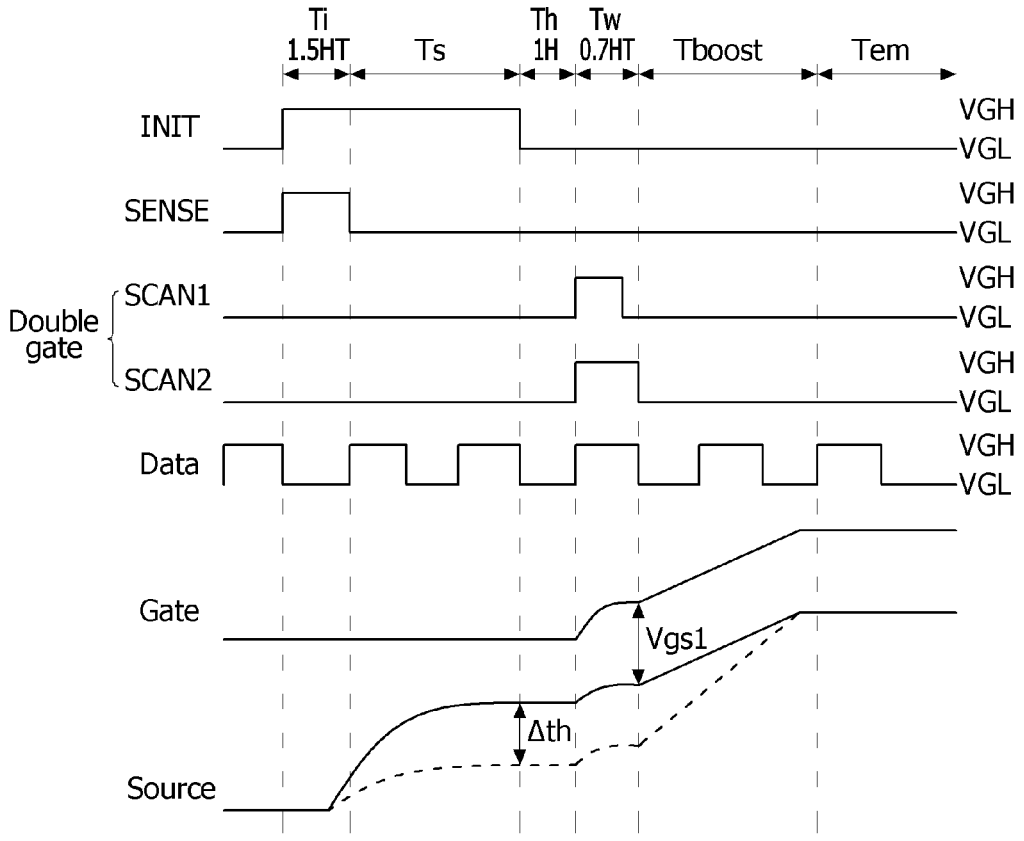

FIG. 10 is a circuit diagram illustrating a pixel circuit according to a fourth embodiment of the present disclosure, and FIGS. 11A and 11B are waveform diagrams illustrating a gate signal applied to the pixel circuit shown in FIG. 10 according to the fourth embodiment of the present disclosure.

Referring to FIG. 10, the pixel circuit according to the fourth embodiment of the present disclosure includes a light emitting element EL, a driving element DT for driving the light emitting element EL, a plurality of switch elements M01, M02 and M03, and a capacitor Cst. The driving element DT and the switch elements M01, M02 and M03 may be implemented as n-channel oxide TFTs.

This pixel circuit is connected to a first power line PL1 to which a pixel driving voltage EVDD is applied, a second power line DL to which a data voltage Vdata is applied, a third power line PL3 to which a low potential power voltage EVSS is applied, a fourth power line PL4 to which an initialization voltage Vinit is applied, a fifth power line RL to which a reference voltage Vref is applied, and gate lines to which gate signals INIT, SENSE, SCAN1 and SCAN2 are applied.

The driving element DT generates a current according to a gate-source voltage Vgs and thereby drives the light emitting element EL. The driving element DT includes a gate electrode connected to a first node n1, a first electrode connected to the first power line PL1 to which the pixel driving voltage EVDD is applied, and a second electrode connected to a second node n2.

The first switch element M01 is turned on according to a gate-on voltage VEH of a first scan pulse SCAN1 and a second scan pulse SCAN2 and applies a data voltage to the first node n1. The first switch element M01 includes a first gate electrode to which the first scan pulse SCAN1 is applied, a second gate electrode to which the second scan pulse SCAN2 is applied, a first electrode connected to the second power line DL to which the data voltage is applied, and a second electrode connected to the first node n1.

The second switch element M02 is turned on according to a gate-on voltage VGH of an initialization pulse INIT and applies the initialization voltage Vinit to the first node n1. The second switch element M02 includes a first electrode connected to the fourth power line PL4 to which the initialization voltage Vinit is applied, a gate electrode to which the initialization pulse INIT is applied, and a second electrode connected to the first node n1.

The third switch element M03 is turned on according to a gate-on voltage VGH of a sensing pulse SENSE and supplies the reference voltage Vref to the second node n2. The third switch element M03 includes a first electrode connected to the second node n2, a gate electrode to which the sensing pulse SENSE is applied, and a second electrode connected to the fifth power line RL to which the reference voltage is applied.

The first capacitor Cst is connected between the first node n1 and the second node n2 and stores a threshold voltage. One end of the first capacitor Cst is connected to the first node n1, and the other end is connected to the second node n2.

As shown in FIGS. 11A and 11B, the pixel circuit may be driven in the order of an initialization period Ti, a sensing period Ts, a data writing period Tw, and a light emission period Tem. In the initialization period Ti, the pixel circuit is initialized. In the sensing period Ts, a threshold voltage Vth of the driving element DT is sensed and stored in the first capacitor Cst. In the data writing period Tw, the data voltage Vdata of pixel data is applied to the first node n1. After the voltages of the first and second nodes n1 and n2 are increased in a boosting period Tboost, the light emitting element EL can emit light with a luminance corresponding to a grayscale value of the pixel data in the light emission period Tem.

The pixel circuit may equally apply the first scan pulse and the second scan pulse as shown in FIG. 11A, and may differently and separately apply the first scan pulse and the second scan pulse as shown in FIG. 11B.

As shown in FIG. 11A, in the initialization period Ti, the second and third switch elements M02 and M03 are turned on, and the first switch element M01 is turned off. The initialization voltage Vinit is applied to the first node n1, and the reference voltage Vref is applied to the second node n2. At this time, the driving element DT is turned on, and the light emitting element EL is not turned on.

In the sensing period Ts, the second switch element M02 maintains the turned-on state and thus the voltage of the first node n1 increases. When the gate-source voltage Vgs of the driving element DT reaches the threshold voltage Vth, the driving element DT is turned off and the threshold voltage Vth is stored in the first capacitor Cst.

In a hold period Th, the second switch element M02 is turned off, and the second node n2 and the first node n1 are floated to maintain the previous voltage.

In the data writing period Tw, the first switch element M01 is turned on. The data voltage Vdata of the pixel data is applied to the first node n1, and thus the voltage of the first node n1 is changed by the data voltage Vdata. The scan pulse SCAN applied to the first switch element M01 during the data writing period Tw may be generated for about 0.7 horizontal period (0.7H). In this case, the data voltage Vdata of the pixel data is not applied through one switch element, but applied through the first switch element M01 having a double gate structure, so that charging characteristics can be improved.

During the boosting period Tboost, the first, second, and third switch elements M01, M02, and M03 are turned off. At this time, the voltages of the first and second nodes n1 and n2 are increased.

In the light emission period Tem, the first, second, and third switch elements M01 M02, and M03 maintain the turned-off state. At this time, a current generated according to the gate-source voltage Vgs of the driving element DT, that is, the voltage between the first and second nodes n1 and n2, is supplied to the light emitting element EL, thereby causing the light emitting element EL to be emitted.

Although the embodiments of the present disclosure have been described in more detail with reference to the accompanying drawings, the present disclosure is not limited thereto and may be embodied in many different forms without departing from the technical concept of the present disclosure. Therefore, the embodiments disclosed in the present disclosure are provided for illustrative purposes only and are not intended to limit the technical concept of the present disclosure. The scope of the technical concept of the present disclosure is not limited thereto. Therefore, it should be understood that the above-described embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A pixel circuit comprising:

a driving element including a first electrode of the driving element that is connected to a first power line to which a pixel driving voltage is applied, a gate electrode of the driving element that is connected to a first node, and a second electrode of the driving element that is connected to a second node;

a first switch element including a first electrode of the first switch element that is directly connected to a second power line to which a data voltage is applied, a gate electrode of the first switch element to which a first scan pulse is applied, and a second electrode of the first switch element that is directly connected to the first node;

a second switch element including a first electrode of the second switch element that is directly connected to the second power line, a gate electrode of the second switch element to which a second scan pulse is applied, and a second electrode of the second switch element that is directly connected to the first node;

a light emitting element including an anode electrode connected to the second node, and a cathode electrode connected to a third power line to which a low potential power voltage is applied; and a capacitor connected between the first node and the second node.

2. The pixel circuit of claim 1, further comprising:

a third switch element including a first electrode of the third switch element that is connected to a fourth power line to which an initialization voltage is applied, a gate electrode of the third switch element to which an initialization pulse is applied, and a second electrode of the third switch element that is connected to the first node; and a fourth switch element including a first electrode of the fourth switch element that is connected to the second node, a gate electrode of the fourth switch element to which a sensing pulse is applied, and a second electrode of the fourth switch element that is connected to a fifth power line to which a reference voltage is applied.

3. The pixel circuit of claim 1, wherein during a period in which the data voltage is applied by a data driver, turn-off time points of the first switch element and the second switch element determined by a gate driver are different from each other.

4. The pixel circuit of claim 3, wherein the turn-off time point of the second switch element varies depending on a resistor-capacitor (RC) delay or a current-resistor (IR) drop of the first power line, the second power line, and the third power line.

5. The pixel circuit of claim 3, wherein a voltage of the first scan pulse applied by a gate driver swings between a first gate-on voltage and a first gate-off voltage, and a voltage of the second scan pulse applied by the gate driver swings between the first gate-on voltage and a second gate-off voltage that is less than the first gate-off voltage.

6. The pixel circuit of claim 3, wherein a voltage of the first scan pulse applied by a gate driver swings between a first gate-on voltage and a first gate-off voltage, and a voltage of the second scan pulse applied by the gate driver swings between a second gate-on voltage that is greater than the first gate-on voltage and the first gate-off voltage.

7. The pixel circuit of claim 3, wherein a voltage of the first scan pulse applied by a gate driver swings between a first gate-on voltage and a first gate-off voltage, and a voltage of the second scan pulse applied by the gate driver swings between a second gate-on voltage that is greater than the first gate-on voltage and a second gate-off voltage that is less than the first gate-off voltage.

8. The pixel circuit of claim 1, wherein during a period in which the data voltage is applied by a data driver, turn-on time points of the first switch element and the second switch element determined by a gate driver are different from each other.

9. A pixel circuit comprising:

a driving element including a first electrode of the driving element that is connected to a first power line to which a pixel driving voltage is applied, a gate electrode of the driving element that is connected to a first node, and a second electrode of the driving element that is connected to a second node;

a first switch element including a first electrode of the first switch element that is directly connected to a second power line to which a data voltage is applied, a first gate electrode of the first switch element to which a first scan pulse is applied, a second gate electrode of the first switch element to which a second scan pulse is applied, and a second electrode of the first switch element that is directly connected to the first node;

a light emitting element including an anode electrode connected to the second node, and a cathode electrode connected to a third power line to which a low potential power voltage is applied; and a capacitor connected between the first node and the second node, wherein the first scan pulse and the second scan pulse are both at a level configured to turn on the first switch element such that the first switch element applies the data voltage to the first node while the first scan pulse is applied to the first gate electrode and the second scan pulse is applied to the second gate electrode.

10. The pixel circuit of claim 9, further comprising:

a second switch element including a first electrode of the second switch element that is connected to a fourth power line to which an initialization voltage is applied, a gate electrode of the second switch element to which an initialization pulse is applied, and a second electrode of the second switch element that is connected to the first node; and a third switch element including a first electrode of the third switch element that is connected to the second node, a gate electrode of the third switch element to which a sensing pulse is applied, and a second electrode of the third switch element that is connected to a fifth power line to which a reference voltage is applied.

11. A method for driving the pixel circuit of claim 1, comprising:

initializing the pixel circuit;

sensing a threshold voltage of the driving element and storing the sensed threshold voltage in the capacitor;

applying a data voltage of pixel data to the first node such that the voltages at the first and second nodes are increased; and emitting, by the light emitting element, light with a luminance corresponding to a gray scale value of the pixel data.

12. A display device comprising:

a display panel including a plurality of data lines, a plurality of gate lines that intersect with the plurality of data lines, a plurality of power lines to which different constant voltages are applied, and a plurality of sub-pixels;

a data driver configured to supply a data voltage of pixel data to the plurality of data lines; and a gate driver configured to supply a gate signal to the plurality of gate lines, wherein each of the plurality of sub-pixels comprise:

a driving element including a first electrode of the driving element that is connected to a first power line of plurality of power lines to which a pixel driving voltage is applied, a gate electrode of the driving element that is connected to a first node, and a second electrode of the driving element that is connected to a second node;

a first switch element including a first electrode of the first switch element that is directly connected to a second power line of the plurality of power lines to which a data voltage is applied, a gate electrode of the first switch element to which a first scan pulse is applied, and a second electrode of the first switch element that is directly connected to the first node;

a second switch element including a first electrode of the second switch element that is directly connected to the second power line, a gate electrode of the second switch element to which a second scan pulse is applied, and a second electrode of the second switch element that is directly connected to the first node;

a light emitting element including an anode electrode connected to the second node, and a cathode electrode connected to a third power line of plurality of power lines to which a low potential power voltage is applied; and a capacitor connected between the first node and the second node.

13. The display device of claim 12, wherein each of the plurality of sub-pixels further comprises:

a third switch element including a first electrode of the third switch element that is connected to a fourth power line of plurality of power lines to which an initialization voltage is applied, a gate electrode of the third switch element to which an initialization pulse is applied, and a second electrode of the third switch element that is connected to the first node; and a fourth switch element including a first electrode of the fourth switch element that is connected to the second node, a gate electrode of the fourth switch element to which a sensing pulse is applied, and a second electrode of the fourth switch element that is connected to a fifth power line of plurality of power lines to which a reference voltage is applied.

14. The display device of claim 12, wherein during a period in which the data voltage is applied by the data driver, turn-off time points of the first switch element and the second switch element determined by the gate driver are different from each other.

15. The display device of claim 14, wherein the turn-off time point of the second switch element varies depending on a resistor-capacitor (RC) delay or a current-resistor (IR) drop of the first power line, the second power line, and the third power line.

16. The display device of claim 14, wherein a voltage of the first scan pulse applied by the gate driver swings between a first gate-on voltage and a first gate-off voltage, and a voltage of the second scan pulse applied by the gate driver swings between the first gate-on voltage and a second gate-off voltage that is less than the first gate-off voltage.

17. The display device of claim 14, wherein a voltage of the first scan pulse applied by the gate driver swings between a first gate-on voltage and a first gate-off voltage, and a voltage of the second scan pulse applied by the gate driver swings between a second gate-on voltage that is greater than the first gate-on voltage and the first gate-off voltage.

18. The display device of claim 14, wherein a voltage of the first scan pulse applied by the gate driver swings between a first gate-on voltage and a first gate-off voltage, and a voltage of the second scan pulse applied by the gate driver swings between a second gate-on voltage that is greater than the first gate-on voltage and a second gate-off voltage that is less than the first gate-off voltage.

19. The display device of claim 12, wherein during a period in which the data voltage is applied by the data driver, turn-on time points of the first switch element and the second switch element determined by the gate driver are different from each other.

20. The display device of claim 12, wherein all transistors in the data driver, the gate driver, and the plurality of sub-pixels are implemented with oxide thin film transistors including an n-channel type oxide semiconductor.

21. A display device comprising:

a display panel comprising a plurality of data lines, a plurality of gate lines that intersect with the plurality of data lines, a plurality of power lines to which different constant voltages are applied, and a plurality of sub-pixels;

a data driver configured to supply a data voltage of pixel data to the plurality of data lines; and a gate driver configured to supply a gate signal to the plurality of gate lines, wherein each of the plurality of sub-pixels comprises:

a driving element including a first electrode of the driving element that is connected to a first power line of plurality of power lines to which a pixel driving voltage is applied, a gate electrode of the driving element that is connected to a first node, and a second electrode of the driving element that is connected to a second node;

a first switch element including a first electrode of the first switch element that is directly connected to a second power line of plurality of power lines to which a data voltage is applied, a first gate electrode of the first switch element to which a first scan pulse is applied, a second gate electrode of the first switch element to which a second scan pulse is applied, and a second electrode of the first switch element that is directly connected to the first node;

a light emitting element including an anode electrode connected to the second node, and a cathode electrode connected to a third power line of plurality of power lines to which a low potential power voltage is applied; and a capacitor connected between the first node and the second node, wherein the first scan pulse and the second scan pulse are both at a level configured to turn on the first switch element such that the first switch element applies the data voltage to the first node while the first scan pulse is applied to the first gate electrode and the second scan pulse is applied to the second gate electrode.

22. The display device of claim 21, wherein each of the plurality of sub-pixels further comprises:

a second switch element including a first electrode of the second switch element that is connected to a fourth power line of plurality of power lines to which an initialization voltage is applied, a gate electrode of the second switch element to which an initialization pulse is applied, and a second electrode of the second switch element that is connected to the first node; and a third switch element including a first electrode of the third switch element that is connected to the second node, a gate electrode of the third switch element to which a sensing pulse is applied, and a second electrode of the third switch element that is connected to a fifth power line of plurality of power lines to which a reference voltage is applied.

23. The display device of claim 22, wherein all transistors in the data driver, the gate driver, and the plurality of sub-pixels are implemented with oxide thin film transistors including an n-channel type oxide semiconductor.

* * * * *